US005678285A

United States Patent [19]

Germani

[11] Patent Number: 5,678,285

[45] Date of Patent: Oct. 21, 1997

[54] ZIPPER FOR HEAVY LOADS

[75] Inventor: Gianfranco Germani, Milan, Italy

[73] Assignee: Terry G. Spragg, Manhattan Beach, Calif.

[21] Appl. No.: 597,897

[22] Filed: Feb. 5, 1996

[51] Int. Cl.[6] ..... A44B 19/00

[52] U.S. Cl. ..... 24/418; 24/403; 24/411

[58] Field of Search ..... 24/418, 419, 387, 24/392, 394, 403, 404, 411, 416, 433, 384, 388, 389, 429, 436; 70/68

[56] References Cited

U.S. PATENT DOCUMENTS

| | | | |
|---|---|---|---|
| 1,775,419 | 9/1930 | Blair | 24/411 |
| 4,502,190 | 3/1985 | Inamura | 24/403 |
| 5,390,396 | 2/1995 | Hirota | 24/433 |
| 5,469,605 | 11/1995 | Horikawa | 24/403 |

FOREIGN PATENT DOCUMENTS

| | | | |
|---|---|---|---|
| 0800347 | 7/1936 | France | 24/411 |

*Primary Examiner*—Victor N. Sakran
*Attorney, Agent, or Firm*—Seed and Berry LLP

[57] ABSTRACT

A zipper has its teeth formed by two interfitting plastic tooth elements one of which has pointed prongs fitting into matching holes in the other tooth element and extending through a fabric mounting strip having a bead clamped between the tooth elements of each zipper tooth. The tooth elements also interfit outwardly of the mounting strip by way of a land and matching recess, and an additional prong and matching hole. The interfitting tooth elements are welded together at the interfit of the prongs and of the land. The zipper is locked in closed position at each end by a locking unit which has a latch with locking pawls which fit between adjoining zipper teeth when the latch is swung into locking position after sliding the locking unit onto an end portion of the zipper.

20 Claims, 4 Drawing Sheets

ZIPPER FOR HEAVY LOADS

TECHNICAL FIELD

The present invention relates to zippers adapted to sustain heavy tensile loads tending to pull the zipper teeth apart. In standard zipper construction opposing rows of zipper teeth are mounted on a pair of fabric mounting strips each presenting a marginal anchoring bead gripped by the respective zipper teeth. The zipper teeth on each strip project beyond the marginal bead by necked heads which are shaped to interfit between a pair of spaced apart opposing teeth on the other strip.

BACKGROUND OF THE INVENTION

In U.S. Pat. No. 5,413,065 there is disclosed a flexible fabric barge having large barge modules connected together end-on-end by zippers. Such barges are designed to carry fresh water, for example, when operating in salt water, and while towed, the substantial towing load is transferred to the zipper teeth and to the fabric strips on which respective rows of the teeth are mounted. These teeth mounting strips are permanently attached to fabric sleeve extensions or collars on the barges and must be flexible enough, particularly in the area adjacent the zipper teeth, to permit normal operation of the slider which causes interfitting of the rows of zipper teeth responsive to movement of the slider therealong.

When the flexible barges are being towed, the resulting load on the mounting strips and zipper teeth is so large that conventional tooth to mounting strip arrangements are not adequate. Furthermore, stitching of the mounting strips to connect them to the barges is not considered to be a viable technique to take the large towing loads. Thus, a need has evolved for a stronger zipper tooth and mounting strip construction.

SUMMARY OF THE INVENTION

The present invention provides a stronger zipper giving each zipper tooth two interfitting tooth elements which are connected together on both sides of the marginal anchoring bead on the associated flexible mounting strip. This connection includes prongs on one of the zipper elements which pass through the mounting strip and extend into the body of the other tooth element. Each mounting strip is of woven yarn construction enclosing a cord to form the anchoring bead for the strip, and contains plastic covered yarn which can be welded to the fabric of the connecting collars or sleeves on the flexible barges. Preferably the mounting strip is in the form of a sleeve giving double thickness and endless weft yarn.

DETAILED DESCRIPTION OF THE INVENTION

Figure 6:
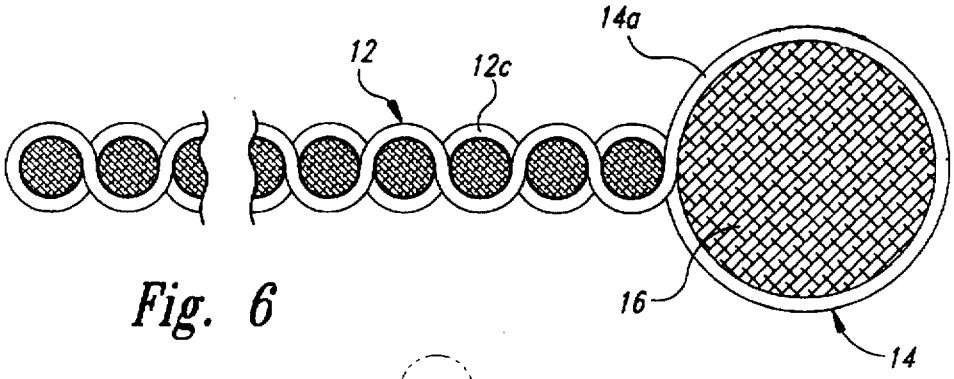
FIG. 6 is a fragmentary transverse sectional view of the mounting strip.
Figure 7:
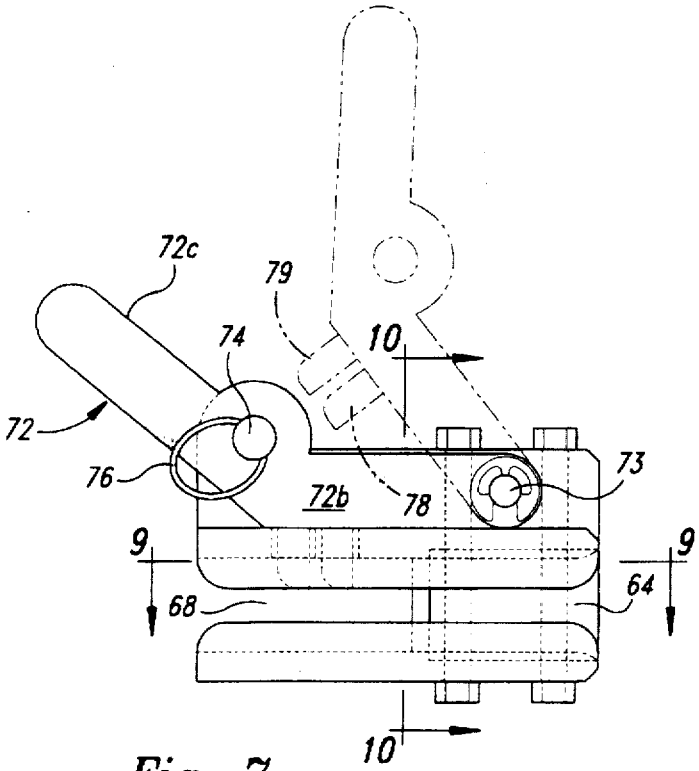
FIG. 7 is a side elevational view of a locking unit used in conjunction with the zipper.
Figure 8:
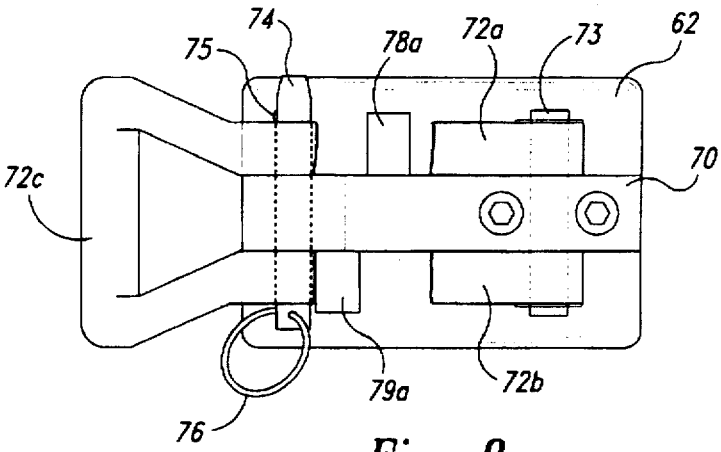
FIG. 8 is a top plan view of the locking unit with a central portion of the legs of the swing latch broken away.

Referring to the drawings, each half of the zipper is composed of a row of teeth 10 each formed by two complementing tooth elements **10*a*–10*b* mounted on a woven fabric strip 12 in back-to-back interfitting relation. The strip 12 has a bead 14 along one longitudinal edge which is gripped by the teeth 10. This bead comprises a core 16, preferably a cord formed from synthetic fibers such as a suitable polyester around which the strip 12 is looped or woven. In the illustrated example the fabric for the strip is doubled upon itself after looping around the core 16 and has two fabric layers. Preferably these two fabric layers are provided by weaving the strip 12 as a sleeve 14*a* having a tubular portion containing the core 16 and having a continuous weft yarn 12*c*** as indicated in FIG. 6.

Figure 1:
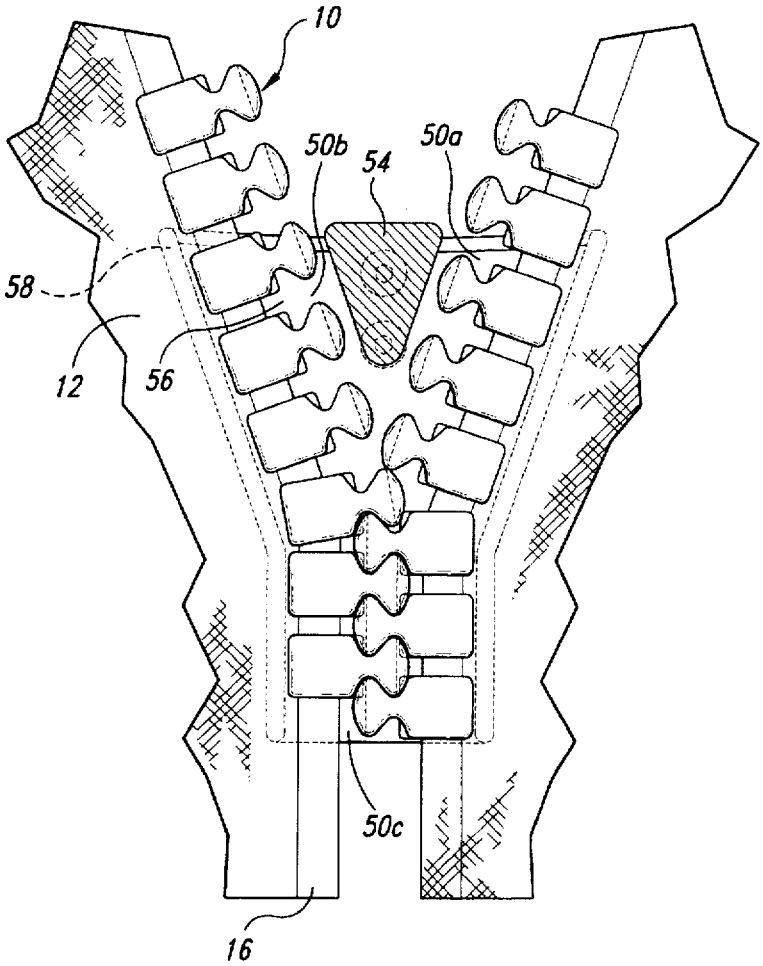
FIG. 1 is a fragmentary plan view of a zipper embodying the present invention shown partly closed with a slider in operating position, the upper part of the slider being removed.
Figure 2:
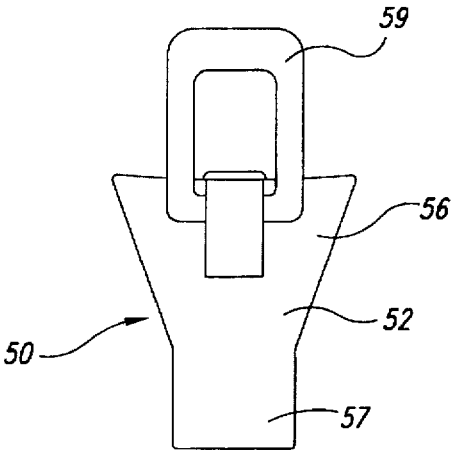
FIG. 2 is a plan view of a typical slider shown in FIG. 1.
Figure 3:
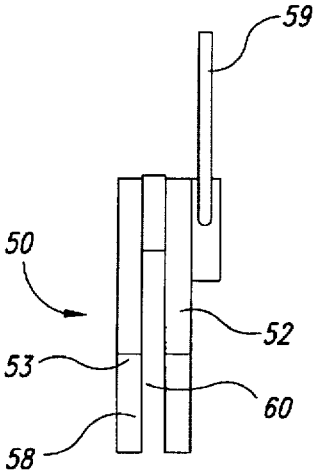
FIG. 3 is a side elevational view of the slider.
Figure 4:
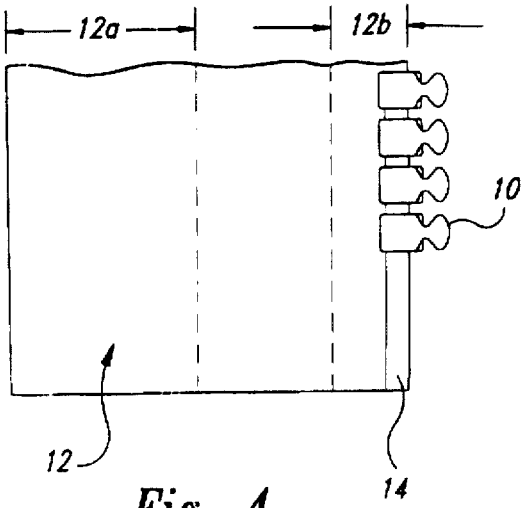
FIG. 4 is a fragmentary plan view of a mounting strip with zipper teeth applied.
Figure 5A:
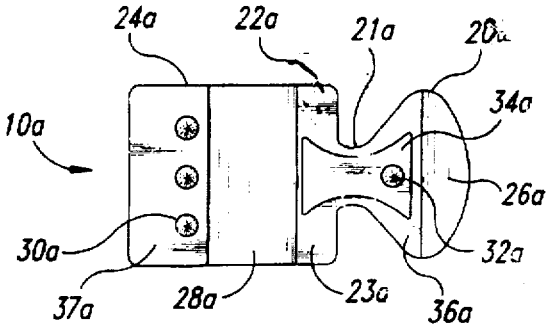
FIGS. 5A and 5B are bottom views of the two zipper elements used to form a zipper tooth in accordance with the present invention.
Figure 5B:
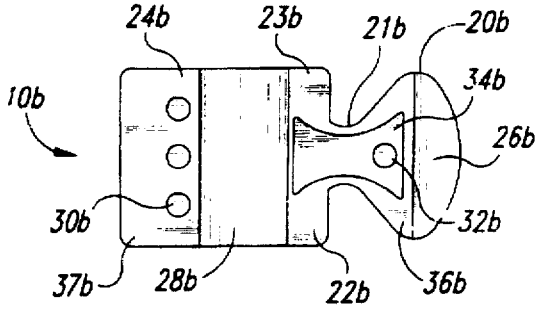
Figure 5C:
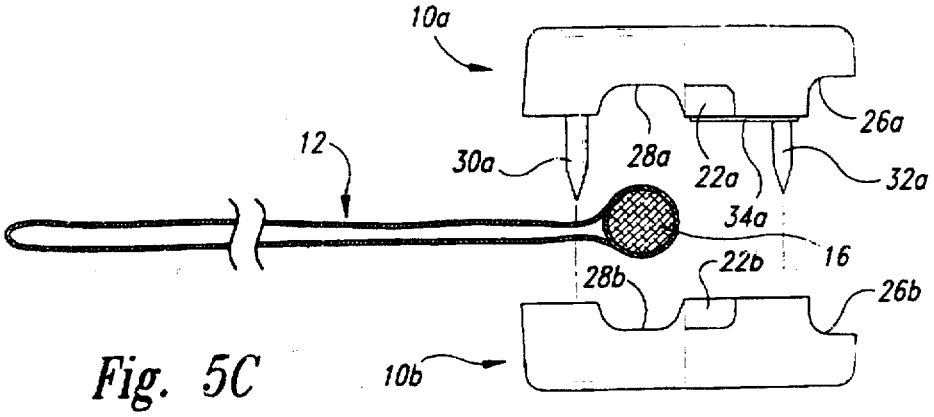
FIG. 5C is a side elevational of the zipper elements aligned for assembly on a mounting strip shown in transverse cross-section.
Figure 5D:
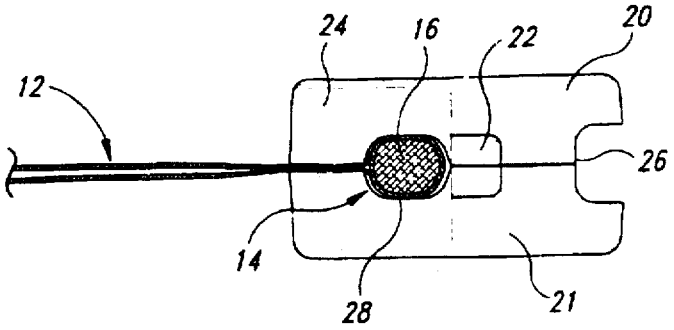
FIG. 5D is a side elevational view of an assembled zipper tooth applied to a mounting strip shown in transverse cross-section.

Referring to FIGS. 5A through 5D, the tooth elements **10*a*–10*b* have respective round head portion 20*a*–20*b*, neck portions 21*a*–21*b*, shoulder flange elements 22*a*–23*a* and 22*b*–23*b*, and body portions 24*a*–24*b*. When the tooth elements 10*a*–10*b* are secured placed back-to-back the head portions 20*a*–20*b*, neck portions 21*a*–21*b*, shoulder flange elements 22*a*–22*b* and 23*a*–23*b*, and body portions 24*a*–24*b* form a head 20, neck 21, shoulders 22–23, and body 24, receptively, as indicated in FIG. 5D. The backs of the head portion of the tooth elements have respective recesses 26*a*–26*b* at the top thereof so that when the tooth elements are back-to-back the recesses 26*a*–26*b* form a transverse crown groove 26 in the head 20. Also, the backs of the body portion 24*a*–24*b* of the tooth elements have respective transverse grooves 28*a*–28*b* so that when the tooth elements are assembled back-to-back the grooves 28*a* define a transverse passage 28*a*–28*b* for the bead 14**.

The tooth elements interfit by way of three prongs **30*a* projecting in a lateral row from the body portion 24*a* of tooth element 10*a*, a flat land 34*a* rising from the neck portion 21*a* of tooth element 10*a* and adjoining areas of the head and body portions 20*a*, 24*a* thereof, and a fourth prong 32*a* projecting from the land 34*a*. The three prongs 30*a*, fourth prong 32*a*, and land 34*a* register with three matching holes 30*b*, fourth hole 32*b*, and recess 34*b* in the tooth element 10*b*. The three prongs 30*a* are pointed for passing through the fabric of the strip 12 and guiding the prongs 30*a* into the complementing holes 30*b*, and the free end of the fourth prong 32*a* is preferably tapered for guiding the prong into the complementing hole 32*b***.

The back of tooth element **10*a* has a first flat face 36*a* surrounding the land 34*a* between the recess 26*a* and groove 28*a*, and has a second flat face 37*a* surrounding the base of the three prongs 30a. Similarly, the back of tooth element 10b has a first flat face 36b surrounding the recess 34b between the respective recess 26b and groove 28b, and has a second flat face 37a surrounding the three holes 30a. The planes of faces 36a–37a and of 36b–37b are parallel, but the planes of faces 37a and 37b are forwardly offset from the planes of faces 36a and 36b, respectively, by at least one-half the thickness of the fabric strip 12. These offsets permit the faces 36a, 36b to engage one another when the tooth elements are fitted together while leaving a gap between the faces 37a, 37b sufficient to receive the fabric strip 12 therebetween as can be seen in FIG. 5D**.

Referring to FIG. 5C, the tooth elements 10a–10b are applied to the fabric strip 12 by clamping them together from opposite sides of the strip so that the three prongs 30a of element 10a pass through the fabric of the strip and seat in the three holes 30b in the element 10b, and so that the fourth prong 32a and land 34a of element 10a seat in the fourth hole 32b and recess 34b of element 10b with the bead 14 clamped in the resulting passage 28 formed by the grooves 28a–28b in the tooth elements. When the prongs 30a pass through the fabric of strip 12 they do not damage the fabric; instead, the prongs spread apart the adjacent warp and weft threads sufficiently to accommodate the prongs.

The tooth elements 10a–10b are injection molded from a suitable plastic whereby the four prongs 30a, 32a and land 34a of element 10a can be welded to element 10b by an ultrasonic welding machine while the tooth elements are held together in interfitting relation. As a result the teeth 10 are firmly clamped onto the bead 14. The teeth are spaced apart along the strip 12 by a distance slightly greater than the width of the neck 21.

As previously indicated, it is preferred that the strip 12 be in the form of a woven fabric sleeve. This makes the strip 12 double in thickness so that it can be sufficiently flexible for proper functioning of the zipper and adequately strong, particularly in the weft (widthwise) direction, to sustain heavy tensile loads. The preferred weft yarn 12c is Vectran high strength (HS) multifilament yarn manufactured by Hoechst Celanese, which has an unusually high tensile strength and resistance to abrasion. It is also preferred that a longitudinal band 12a of the strip 12 starting at the longitudinal edge of the strip remote from the bead 14 have its warp (lengthwise) yarn weldable. Accordingly, this warp yarn can be polyester yarn covered by co-extrusion with polyvinylchloride which is weldable by an RF welder to fabric also having exposed polyvinylchloride. A band 12b of the strip 12 adjoining the bead 14 preferably has its warp and weft yarn both of Vectran HS yarn to give the strip 12 better flexibility adjacent the bead and beyond the zipper teeth, than would be the case if the warp yarn included a polyvinylchloride covering. The area of the strip 12 between the bands 12a, 12b need not be as flexible as the band 12b, and so, like the band 12a, may have its warp yarn covered with polyvinylchloride for increased protection of the weft yarn in that area against abrasion.

The head 20, neck 21 and shoulder portions of the body 24 of the teeth 10 are rounded and shaped such that two rows of the teeth mounted on side-by-side strips can be interfitted by action of a slider 50 as is conventional in the zipper art. When so interfitted opposite side portions of each head 20 fit into the rounded recess between the respective head and adjacently shoulder of the adjoining teeth on the opposite strip.

The slider 50 has matching top and bottom shells 52–53 which are mounted as by bolts in opposing relation on a tapered divider 54 located at the forward ends of the shells. In plan view the shells each have a tapering web section 56 merging at its narrow end with a straight web section 57 and along their longitudinal side edges the shells 52–53 each have a side flange 58. The effective thickness of the divider 54 is such that the opposing web sections 56 and 57 of the shells 52–53 are spaced apart sufficiently for passage of the zipper teeth therebetween. It will be noted that the opposing side flanges 58 of the shells are spaced apart sufficiently to provide gaps 60 for receiving the fabric strips 12 when the slider is in use.

The divider 54 is generally triangular in plan view to provide a rounded tapered nose 55a directed rearwardly and side guide walls which diverge forwardly to the front end of the slider to separate front passages 50a–50b which converge at about 42 degrees with a rear passage 50c which has a width slightly greater than the overall distance between the outer edges of the bodies 24 of interfitted teeth 10. The slider is introduced with its wider end at the free end of two of the strips 12. The teeth on the strips enter the front passages 50a–50b and interfit as they move together behind the divider 55 into the passage 50c responsive to the slider being moved along the strips 12 as by pulling on a handle 59 mounted on the shell 52.

Figure 9:
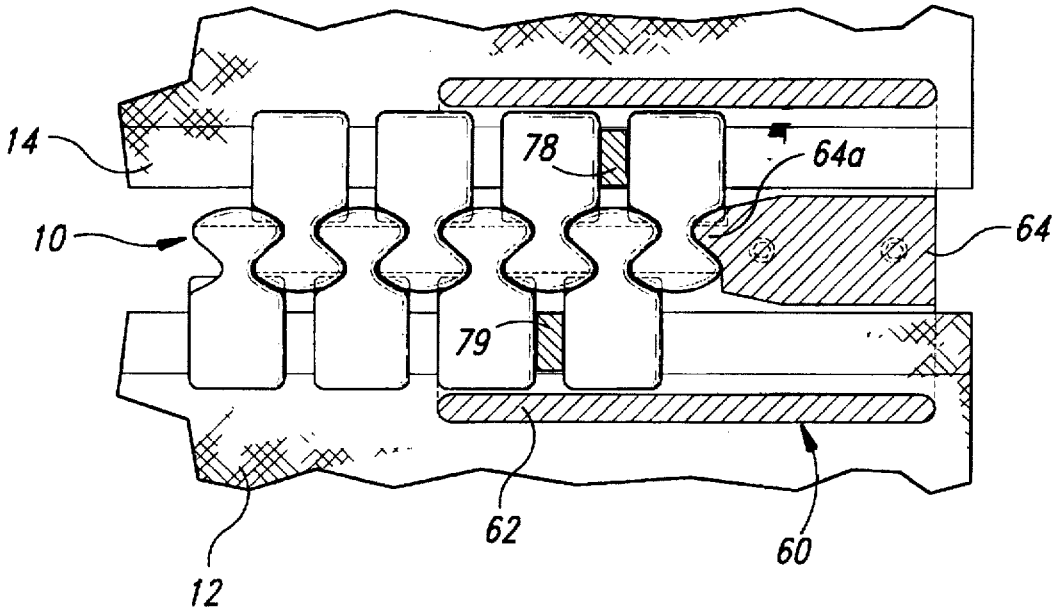
FIG. 9 is a fragmentary plan view of the zipper with the locking unit in the zipper locking position, the locking unit being shown in section taken as indicated by line 9—9 in FIG. 7.
Figure 10:
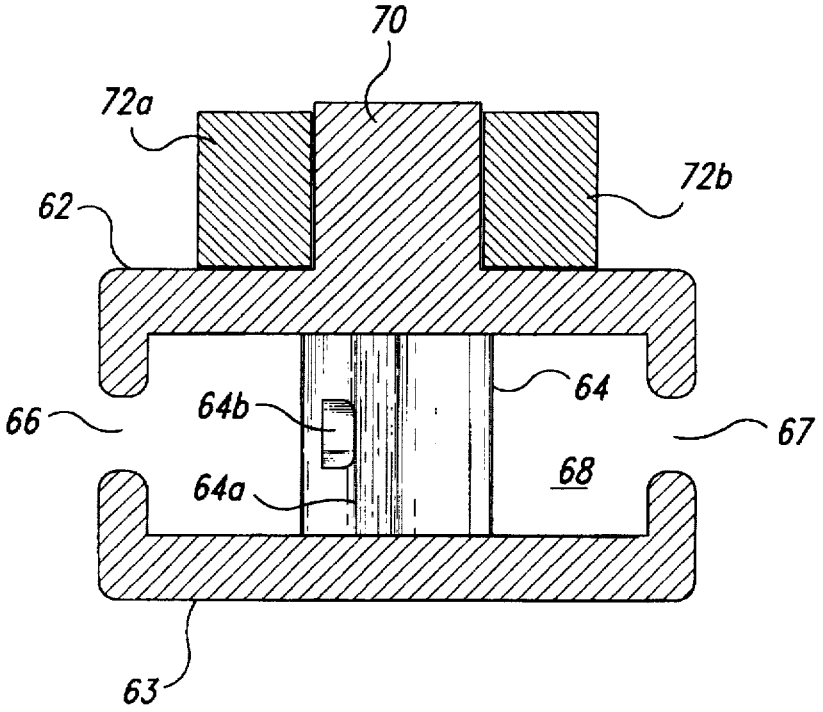
FIG. 10 is a transverse vertical sectional view of the locking unit taken as indicated by line 10—10 in FIG. 7.

Referring to FIGS. 7–10, when closure of the zipper has started by introduction and movement of the slider 50 along an entry portion of a first end of the zipper, a locking unit 60 is introduced. This unit has upper and lower opposed channel members 62, 63 connected together in spaced relation by a front divider wall 64. The leading end of the divider wall 64 has a nose 64a shaped to interfit with a tooth at the neck of the tooth as shown in FIG. 9. Nose 64a has a central notch 64b for interfitting with a shoulder flange 22 or 23 of one of the zipper teeth. The spacing between the channel members 62, 63 provides side openings 66, 67 to a longitudinal passageway 68 divided at the front by the divider wall 64. On the top of the web of the channel member 62 a mounting wall 70 extends along the longitudinal center of the channel. This wall 70 is straddled by a generally V-shaped swing latch 72 having a pair of parallel legs 72a, 72b joined by a forward handle 72c which is sloped upwardly from the front ends of the legs 72a, 72b for easy manual access to the handle. The legs 72, 72b are swing-mounted at the rear on a pivot pin 73 passing through the mounting wall 70, and the swing latch 72 can be locked in lowered latched position by inserting a locking pin 74 through registering holes in the legs 72a, 72b and mounting wall 70. The locking pin 74 preferably has a tapered entry nose, adjacent a spring-loaded detent 75, and has a pull ring 76 passing through a transverse hole in the locking pin adjacent the tail end of the pin.

The swing latch 72 presents two locking pawls 78, 79 on the underside of its legs 72a, 72b which register with openings 78a, 79a (FIG. 8) in the web of the upper channel 62 when the latch is in lowered locking position engaging the top of the channel 62. When in locking position, the pawls 78, 79 project beyond the openings 78a, 79a into the longitudinal passage 68 and are spaced apart relative to one another longitudinally and laterally of the locking unit. The longitudinal spacing is a distance corresponding to the width of the body portion 24 of the zipper teeth, and the lateral spacing of the pawls 78 corresponds to approximately the distance from the crown of the head portion 20 to the longitudinal center of the body portion 24 of a zipper tooth.

The locking unit 60 with its latch 72 in raised inactive position, is introduced to a closed end of the zipper by sliding it longitudinally so that the teeth at the closed end enter the passageway 68 with the mounting strips 12 extending through the side openings 66, 67. The locking unit is advanced along the zipper until the forward end of the divider wall 64 engages the exposed sides of the two end teeth of the zipper. Then the outer shoulder flange 22 or 23 of the outermost tooth interfits with the notch **64*b* in the nose 64*a* of the divider wall (see FIG. 9). The latch handle 72*c* is then swung downwardly into latching position wherein the pawls 78, 79 project downwardly into the spaces between zipper teeth at both sides of the zipper as seen in FIG. 9. The locking pin 74 is then inserted. With the described arrangement the closed end of the zipper is held closed in the passageway 68 by the opposed side flanges of the channels 62, 63 and the locking unit is retained on the zipper by the interfit of the pawls 78, 79** with the zipper teeth.

When the full length of the zipper is closed by movement of the slider 50 to the second end of the zipper, the slider is removed at the second end and a second locking unit 60 is positioned at the second end of the zipper in the same manner as previously described for the other locking unit. The two locking units keep the zipper closed when it is subjected to towing loads. When it is desired to open the zipper to separate barge modules, for example, the locking pins 74 are removed, the handles **72*c* are swung outwardly to retract the pawls 78, 79, and the locking units 60** are moved endwise free of the zipper. The zipper can then be easily opened by pulling its ends apart.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A zipper tooth comprising:

two complementing tooth pieces each having a head end, a foot end, a back side and lateral sides, said tooth pieces being positioned in back-to-back relation, said tooth pieces each having a head portion, a body portion, and neck portion between and laterally narrower than said head and body portions, said tooth pieces interfitting at their head portions and at their body portions, and their body portions jointly providing a laterally extending passage therebetween adjacent said neck portions, the back sides of said head portions being in engagement with one another and there being a gap between the back sides of said body portions extending from said passage to the foot end of the body portions except where the body portions interfit.

2. A zipper tooth according to claim 1 in which the interfit at the body portions of said tooth pieces includes a pointed prong projecting from the back side of the body portion of one of said tooth pieces into a hole in the body portion of the other of said tooth pieces.

3. A zipper tooth according to claim 1 in which the interfit at the head portions of said tooth pieces includes a prong projecting from the back side of the head portion of one of said tooth pieces into a hole in the head portion of the other of said tooth pieces.

4. A zipper tooth according to claim 1 in which the interfit at the head portions of said tooth pieces includes a land projecting from the back side of the head portion of one of said tooth pieces into a recess in the head portion of the other of said tooth pieces.

5. A zipper tooth according to claim 4 in which said land and recess extend part way into the neck portions of the tooth pieces.

6. A zipper tooth according to claim 4 in which the interfit at the head portions of said tooth pieces also includes a prong projecting from said land into a hole in the head portion of said other tooth piece, the mouth of said hole being at the bottom of said recess.

7. A zipper tooth according to claim 1 in which the interfit at the body portions of said tooth pieces includes pointed prongs projecting from the back side of the body portion of one of said tooth pieces into respective holes in the body portion of the other of said tooth pieces, and in which the interfit at the head portions of said tooth pieces includes a land projecting from the back side of the head portion of one of said tooth pieces into a recess in the head portion of the other of said tooth pieces.

8. A zipper tooth according to claim 7 in which the interfit at the head portions of said tooth pieces also includes a prong projecting from the back side of the head portion having said land into a hole in the other head portion.

9. A zipper tooth according to claim 1 in which said tooth pieces have complementing shoulder flanges at the head end of said body portions laterally of said neck portions which are positioned back-to-back to form a pair of shoulder extensions, and in which the back of said head portions of the tooth pieces are recessed at their head end to provide an exposed head groove for receiving the shoulder flanges of adjoining zipper teeth in a zipper containing interfitting rows of said zipper teeth.

10. In combination with a zipper tooth according to claim 1, a flexible mounting strip in said gap having a bead in said passage, the interfit between the body portions of said tooth pieces being accomplished in part by structure passing through said mounting strip.

11. The combination of claim 10 in which said structure includes a pointed prong projecting from the back side of the body portion of one of said tooth pieces through said strip into a hole in the body portion of the other of said tooth pieces.

12. A zipper assembly comprising:

a flexible mounting strip having a bead along a longitudinal edge thereof;

two interfitting parts, each with a head portion, a body portion, and a neck portion located between said head and body portions, a passage jointly provided by said body portions receiving said bead with said mounting strip extending by its width between said body portions, and a prong extending from one of said body portions into the other body portion and passing through said mounting strip, said prong being shaped so as to pass through said mounting strip when said parts are fitted together from opposite sides of the mounting strip.

13. A zipper assembly according to claim 12 in which multiple said prongs extend from one of said body portions through said mounting strip into the other body portion.

14. A zipper assembly according to claim 12 in which a land extends from the head and neck portions of one of said parts into a mating recess in the head and neck portions of the other of said parts.

15. A zipper assembly according to claim 14 in which another prong extends from said land into the head portion of said other of said parts.

16. A zipper assembly according to claim 12 in which said parts are molded from plastic and are welded together where they interfit.

17. A zipper assembly according to claim 12 in which said mounting strip has a woven synthetic yarn construction having interwoven warp and weft yarns, said mounting strip enclosing a cord to form said bead.

18. A zipper assembly according to claim 17 in which said mounting strip has some of its yarns covered with a weldable plastic.

19. A zipper assembly according to claim 12 in which said strip comprises a woven sleeve.

20. A zipper assembly according to claim 19 in which said sleeve is woven around a cord to provide said bead.

* * * * *